US009480302B2

(12) United States Patent
Freschi

(10) Patent No.: US 9,480,302 B2
(45) Date of Patent: Nov. 1, 2016

(54) SHOE HAVING IMPROVED CUSHIONING AND PROPULSION

(75) Inventor: Christian Freschi, Montaut (FR)

(73) Assignee: ENKO, Villepinte (FR)

( * ) Notice: Subject to any disclaimer, the term of this patent is extended or adjusted under 35 U.S.C. 154(b) by 9 days.

(21) Appl. No.: 14/006,682

(22) PCT Filed: Mar. 23, 2012

(86) PCT No.: PCT/FR2012/050614

§ 371 (c)(1),
(2), (4) Date: Dec. 5, 2013

(87) PCT Pub. No.: WO2012/131244

PCT Pub. Date: Oct. 4, 2012

(65) Prior Publication Data

US 2014/0165428 A1 Jun. 19, 2014

(30) Foreign Application Priority Data

Mar. 25, 2011 (FR) ..... 11 52515

(51) Int. Cl.

| | |
|---|---|
| ***A43B 13/00*** | (2006.01) |
| ***A43B 13/14*** | (2006.01) |
| ***A43B 13/28*** | (2006.01) |

(Continued)

(52) U.S. Cl.

CPC ..... *A43B 13/181* (2013.01); *A43B 13/141* (2013.01); *A43B 13/182* (2013.01); *A63B 25/10* (2013.01); *A43B 21/30* (2013.01)

(58) Field of Classification Search

CPC A43B 13/181; A43B 13/182; A43B 13/141; A63B 25/10

USPC ..... 36/27, 102, 31

See application file for complete search history.

(56) References Cited

U.S. PATENT DOCUMENTS 1,613,538 A * 1/1927 Schad ..... A43B 13/184 36/7.8
1,726,028 A * 8/1929 Keller ..... A63B 25/10 36/7.8

(Continued)

FOREIGN PATENT DOCUMENTS

CH 698663 B1 * 9/2009 ..... A43B 5/06
WO WO 2005/011419 A2 2/2005
WO WO 2005011419 A2 * 2/2005 ..... A43B 13/184

OTHER PUBLICATIONS

International Search Report, Jun. 28, 2012, from International Phase of the instant application.

(Continued)

*Primary Examiner* — Khoa Huynh
*Assistant Examiner* — Katharine Gracz
(74) *Attorney, Agent, or Firm* — Paul & Paul

(57) ABSTRACT

The invention relates to a shoe (C) including a shoe portion and a sole (S), the sole including two main portions that are pivotably connected together and being characterized in that the second front portion (200), secured to the shoe portion of the forepart, extends to the rear of a first swivel pin (A1) in a lever arm portion (210), projects to the rear within the same plane as that of the front portion (200), and is kinetically secured to the latter. The rear end of said arm has a second swivel pin (A2) with the end (310) of at least one resilient module (300), the other end (320) of which is pivotably connected around a third swivel pin (A3) secured to the rear end of the rear portion (100) of the sole (S).

12 Claims, 15 Drawing Sheets

(51) Int. Cl.

| | |
|---|---|
| ***A43B 13/18*** | (2006.01) |
| ***A63B 25/10*** | (2006.01) |
| *A43B 21/30* | (2006.01) |

(56) References Cited

U.S. PATENT DOCUMENTS

| | | | | | |
|---|---|---|---|---|---|
| 1,964,406 | A * | 6/1934 | Pellkofer | A43B 3/128 | 36/11.5 |
| 5,706,589 | A * | 1/1998 | Marc | A43B 13/18 | 36/27 |
| 6,115,942 | A * | 9/2000 | Paradis | A43B 21/30 | 36/27 |
| 6,134,812 | A * | 10/2000 | Voss | A43B 13/206 | 36/102 |
| 6,397,496 | B1 * | 6/2002 | Seymour | A43B 5/00 | 36/27 |
| 7,905,033 | B1 * | 3/2011 | Perenich | A43B 13/141 | 36/102 |
| 7,950,166 | B1 * | 5/2011 | Perenich | A43B 13/141 | 36/102 |
| 2003/0126761 | A1 | 7/2003 | Haves | | |
| 2003/0134720 | A1 * | 7/2003 | Yoon | A63B 25/02 | 482/77 |
| 2005/0005472 | A1 * | 1/2005 | Perenich | A43B 13/181 | 36/27 |
| 2005/0262725 | A1 * | 12/2005 | Rennex | A43B 13/14 | 36/7.8 |
| 2006/0137217 | A1 * | 6/2006 | Asmundson | A43B 13/182 | 36/7.8 |
| 2008/0141559 | A1 * | 6/2008 | Marc | A43B 13/203 | 36/27 |
| 2010/0287789 | A1 * | 11/2010 | Mo | A43B 13/125 | 36/28 |

OTHER PUBLICATIONS

English Translation of the Written Opinion of the International Search Authority, Sep. 25, 2013, from International Phase of the instant application.

* cited by examiner

SHOE HAVING IMPROVED CUSHIONING AND PROPULSION

FIELD OF APPLICATION OF THE INVENTION

This invention relates to the field of shoes and in particular to the adaptations making it possible to optimize the cushioning, support and propulsion phases of a stride.

DESCRIPTION OF PRIOR ART

A stride can be broken down into three phases: reception, support and thrust.

These three phases can be described as follows:

- a reception phase wherein the contact with the ground and the cushioning are carried out in the vicinity of the rear of the foot, i.e. rather on its heel for a normal stride (jogger, long-distance runner, walking), or on the forepart for a stride of the sprint or middle distance type,
- a support phase where the support is carried out with the center of gravity of the body in the vicinity of the vertical of the foot with the forepart and the heel in contact with the ground, and
- a propulsion or thrust phase carried out on the front of the foot with the heel raised.

To accompany and assist in carrying out such a stride, the state of the art proposes a plurality of shoes likely to carry out a cushioning of the reception phase in the best conditions. These shoes use the same principle, i.e. the compression of an elastic means during the reception phase.

More recently, shoe designers have been led to propose shoes that can improve the thrust phase by also using an elastic means intended to restore a portion of the energy stored during the thrust phase.

The applicant has observed several disadvantages to this type of shoe of which certain are described hereinafter.

When cushioning is privileged, the shoe provides a cushioning of the shock impact during the reception and does not provide any accompaniment for the propulsion.

When the shoe proposes to improve both the cushioning and the propulsion, it appears that the return of the elastic means succeeds almost simultaneously the reception phase and therefore does not intervene in thrust phase but in support phase. The consequence is that if the propulsion is improved, the natural stride of the runner is substantially modified which renders the utility of such a shoe entirely relative. It also appears in this type of configuration that the excess of the use of the elastic means separates the foot from the ground and results in constant instability.

Another disadvantage observed is that the shoes adopting such improved characteristics see their configuration dedicated and cannot return to a configuration that has conventional characteristics that authorize a conventional stride and gait.

The document WO 2005/011419 describes a shoe sole for walking, running and jumping that provides for the recovery of the energy during the support phase and that redistributes it during thrust phases. However, this sole which, in an embodiment has the shape of a parallelogram, merely manages the coming together and the separation of the horizontal portions of the parallelogram by means of a spring working in tension. The pivot connection between the portion of the sole linked to the forepart and that linked to the rear of the foot does not exist or is not controlled by said parallelogram.

In addition, such a document does not describe the possibility of returning to a normal configuration which authorizes a stride or an arch without accompaniment or cushioning.

It indeed appears that although the state of the art describes a plurality of solutions for cushioning and/or accompaniment, the soles and the shoes proposing these solutions are not in a position to authorize a normal gait, which decreases commercial scale of such shoes.

Indeed, in the current state of the art, the more the cushioning and the accompaniment are effective, the less the shoe obtained is able to resemble or reproduce normal aesthetics and gait.

DESCRIPTION OF THE INVENTION

Taking these conditions into account, the applicant has conducted research having for purpose to design a shoe that overcomes the aforementioned disadvantages by optimizing the phases of cushioning, support and thrust.

Another objective of the invention is to propose a shoe that complies with the natural stride.

Another objective of the invention is to propose a shoe that can return to a conventional configuration making it possible to practice in particular walking in normal and comfortable conditions.

This research resulted in the design of a shoe comprising a shoe portion and a sole, said sole comprises two main portions that are pivotably connected together:

- a first rear portion linked to the rear and median zone of the shoe portion of the shoe, and
- a second front portion linked to the zone of the forepart of the shoe portion of the shoe.

These two portions of soles are pivotably connected according to a first horizontal cross pin located substantially under the natural joint between the forepart and the rear portion of the foot.

In accordance with the invention, the second front portion secured to the shoe portion of the forepart extends to the rear of said first swivel pin in a portion forming a lever arm and is projected to the rear in the same plane as that of the front portion and kinetically secured to the latter. The first swivel pin is therefore located in a median position between the front end of the second front portion and the rear end of said lever arm. According to the invention, the extension of the front sole complies with a proportion of length of ⅔ (two-thirds) and ⅓ (one-third) on either side of the swivel pin, i.e. ⅔ for the front portion and ⅓ for the rear portion.

The rear end of this arm has a second swivel pin with the end of at least one elastic module of which the other end is pivotably connected around a third swivel pin secured to the rear end of the rear portion of the sole in such a way that when the triangle formed by the three swivel pins is flattened, the three pins become substantially coplanar and the elastic module is compressed and wedged.

This cushion has a variable length, a variation accompanied by an elastic module which will authorize the triangle or the prism of triangular section formed by the three swivel pins to be flattened in order to compress the cushion and to separate it during the release of the latter. This flattening creates a blocking of the system at the end of travel. Indeed, the elastic module working on the compression is blocked by the aligning effect of the three pivot connection points, i.e. when the swivel pins become substantially coplanar.

This characteristic will make it possible to follow the phases of the method consisting in:

transforming, during the impact of the reception phase, the kinetic energy into potential energy by putting the elastic module under pressure, maintaining the elastic module wedged under pressure in the support phase, and releasing the elastic module in propulsion phase.

The deferred release of this elastic module makes it possible to restore the accumulated energy at the correct time i.e. for the propulsion phase.

In addition, the storage of this potential energy will make it possible to release at the correct time and at the correct location i.e. in the front portion of the foot where the sensing line for the propulsion phase is located.

The deferred restitution of the energy has several advantages and among these:

the cushioning is of high quality as it prevents any impact in the leg due to parasitic restitution of the energy, in support phase, the foot remains very stable thanks to a frank and direct contact between the foot and the ground, with the effects of the elastic module being cancelled by the effect of the wedging due to the alignment of the three points, the restitution in propulsion phase will allow for the increase in performance and therefore a savings in energy, etc.

Another aspect studied by the applicant relates to the duration during which the stored energy is restored. All of the energy is restored during the separation phase of the heel by a movement of rotation around the first swivel pin (front swivel pin), with the spring taking support on the ground and pushing on the rear of the heel. The restitution is optimal.

According to a particularly advantageous characteristic, the release of said elastic module is carried out progressively in order to accompany the foot during the greatest portion of the propulsion phase. This restitution which is slower than what is proposed by existing devices and methods makes it possible to better respect the ligament tissue and to assist the muscular contraction and relaxation of the propulsion phase.

As such, the method implemented by the sole of the invention proposes a restitution of the elastic module over a longer duration than the duration of the storage phase.

According to a particularly advantageous characteristic, said shoe comprises two elastic modules arranged on either side of the foot in the concave volumes of the sole corresponding to the natural outside and inside cavities of the arch of the foot. Such a disposition allows the three swivel pins, as well as the cushion and the two portions of the sole to be aligned (to become coplanar) provoking the neutralization of the cushion. Such an exterior and visible disposition makes it possible to provide an attractive aesthetic aspect to the shoe by providing it with a high-tech design. The stability as well as the weight of the shoe are furthermore improved due to the fact that the mobile portions can be brought together without the elastic modules being inserted between them. Indeed, these cushions are secured to the outside edges of the mobile portions that authorize them to be put into contact. In addition, the ease of access to the cushions facilitates their adjustment and their interchangeability. This facilitated adjustment will allow for the management of the pronation by acting of the various adjustments between the inside cushion and the outside cushion.

Of course, an embodiment of the shoe of the invention comprises a single elastic module or outside cushion. Indeed, as the pivoting connections are comprised of pivot links, the presence of a single cushion authorizes the same movements.

The elastic module is arranged and pivotably connected in relation to two sole assembly portions in such a way that the direction of the tension efforts of said elastic module is positioned in a manner substantially parallel to the ground when the two parties of the sole assembly are connected together. The maintaining under tension then operates according to a toggle system wherein the elastic module is in a mechanically neutral position without need of a stop when the shoe is at the end of the cushioning phase. According to a preferred embodiment, said elastic module operates through compression. This particularity has for advantage to subject the shortest elements to compression and the longest elements to tension which prevents an oversizing of the various portions forming the sole. The sole of the invention substantially retakes the width of a conventional sole and furthermore authorizes the receiving of the cushions in the two hollows formed by the arch of the foot on either side of the foot and therefore by the shoe.

Due to the arrangement of the swivel pins, the shoe proposes for the same elastic module formed by the two cushions a direction and a course that are different for the tensioning and for the release. This different course will make it possible to implement the method consisting in proposing a restitution phase that is more progressive and slower than the storage phase corresponding to the different respective needs of the runner for the reception and propulsion phases.

According to another particularly advantageous characteristic, the elastic module comprises at least one spring. According to a non-restricted embodiment, said module is comprised of one or several springs associated with rods of which the ends are pivotably connected respectively to the mobile front portion of the sole and to the rear portion.

According to another particularly advantageous characteristic, the stiffness of the elastic module is defined in such a way that the action of the weight of the user on the shoe makes it possible to reach the support position wherein the elastic module is inactive in relation to the shoe and wherein the lower surface of the rear portion of the sole comes into contact with the upper surface of the rear arm of the front portion of the sole. As such, during the stride at each end of the reception phase and during the support phase, the shoe again becomes a shoe with conventional mechanical characteristics. As such, it must be well understood that, during the stride, the mobile portions come to abut and therefore as support against one another during the support phase preceding the propulsion phase contrary to the shoes proposing inserted springs which do not make it possible to stabilize the end of travel.

Another objective of the invention is to propose a shoe having means for correction via adjustments or via the interchangeability of the elements such as the elastic means, the position of the pivot links or pivoting connections, the surfaces in contact in order to adapt to the following parameters:

weight of the runner and any defect in terms of morphology (supination and pronation), frequency and amplitude of the stride according to the runner, condition of the ground (asphalt, outdoor ground, etc.), positive or negative differences in level.

To do this, the tension of said springs can be different from one cushion to the other. In addition, this tension can advantageously be regulated through the use of screw stiffeners, by replacing springs or by the association of several springs for the same elastic module or cushion. According to a preferred embodiment, each cushion is adjustable independently for example over a range from one to ten kilograms. In addition, a set of several cushions makes available different cushions in brackets of ten kilograms. As such, the capacities for cushioning and for restitution of the energy of the shoe can be adapted to the weight of its user and to its use which can define other parameters than that of the weight. According to another characteristic, the shoe is remarkable in that the elastic modules have different degrees of stiffness on either side of the foot.

According to another particularly advantageous characteristic of the invention, the shoes of the invention propose a return to a gait or to a stride that is not accompanied and not cushioned. To do this, said shoe comprises a means for locking the two portions of the sole assembly together in support phase wherein they are coplanar in order to prevent for example the effects of the elastic module during the other phases. Said means for locking maintains the two portions of soles in contact in the position taken in support phase.

This means for locking fully cancels out the effect of the elastic module and returns the shoe to a conventional configuration making it possible to practice in particular walking in normal conditions.

This means for locking also makes it possible to maintain, if it is not released, a conventional configuration of the shoe. As it can be accessed from the exterior, this system for locking allows the user to implement it while leaving the shoe on using the ground, the hand, the other foot, etc.

The implementation of the locking or of the unlocking requires very little effort as it is carried out when the two portions of sole are in a position close together and when the elastic module has its effects cancelled due to its position. As such the working method consists in locking the shoe in support phase in order to adopt an operating method of a conventional shoe.

According to an embodiment, the shoe comprises a means for locking the elastic module in compressed position.

According to another solution considered, the movement of the two sole assembly portions is accompanied by a system of the ratchet type which is released only when a certain angular amplitude is reached between the forepart and the rear of the foot.

According to another particularly advantageous characteristic, the shoe comprises a disengagement device switching as controlled by the user from a disengaged position wherein the elastic module or modules are inactive and free to an engaged position wherein the elastic module or modules accompany the movement of the portions of sole. The means for locking mentioned hereinabove will prevent the movement of the portions of sole between them when the elastic modules are disengaged.

According to a preferred embodiment wherein the cushion is comprised of a metal rod and of a spring, the link between the rod of the cushion and the third swivel pin is controlled by a control button which switches from an engaged position to a disengaged position and vice-versa. The engaged position maintains in position the end of the rod in relation to the swivel pin in such a way as to allow the sole to transmit its movement to the cushion for the purposes of compression and the cushion to transmit its energy to the sole during its extension. The disengaged position authorizes the rod of the cushion to slide perpendicularly in relation to said third swivel pin in such a way that the movement of the mobile portions of the sole only cause the rod of the cushions to slide perpendicularly to the swivel pin without the latter being compressed or extended.

This solution has for advantage to not have the cushions intervene without blocking the pivoting connection between the two main portions of the sole.

According to a particularly advantageous characteristic of the invention, a mobile intermediary sole that is pivotably connected in relation to the front portion of the sole on the one hand, to a first end around said second swivel pin and on the other hand, around a fourth swivel pin carried by the bottom end of a linking module of which the top end is pivotably connected around the third swivel pin, the fourth swivel pin is arranged on said mobile intermediary sole in such a way that the linking module is parallel to the front portion of the sole in such a way as to form a configuration as a parallelogram. The lower and upper surfaces of the soles then come into contact on the linking module when the elastic module is compressed or inactive.

As the fundamental concepts of the invention have just been exposed hereinabove in their most elementary form, other details and characteristics shall appear more clearly when reading the following description and with regards to the annexed drawings, providing by way of a non-restricted example, an embodiment of a shoe in accordance with the spirit of the invention.

DESCRIPTION OF PREFERRED EMBODIMENTS

Figure 1:
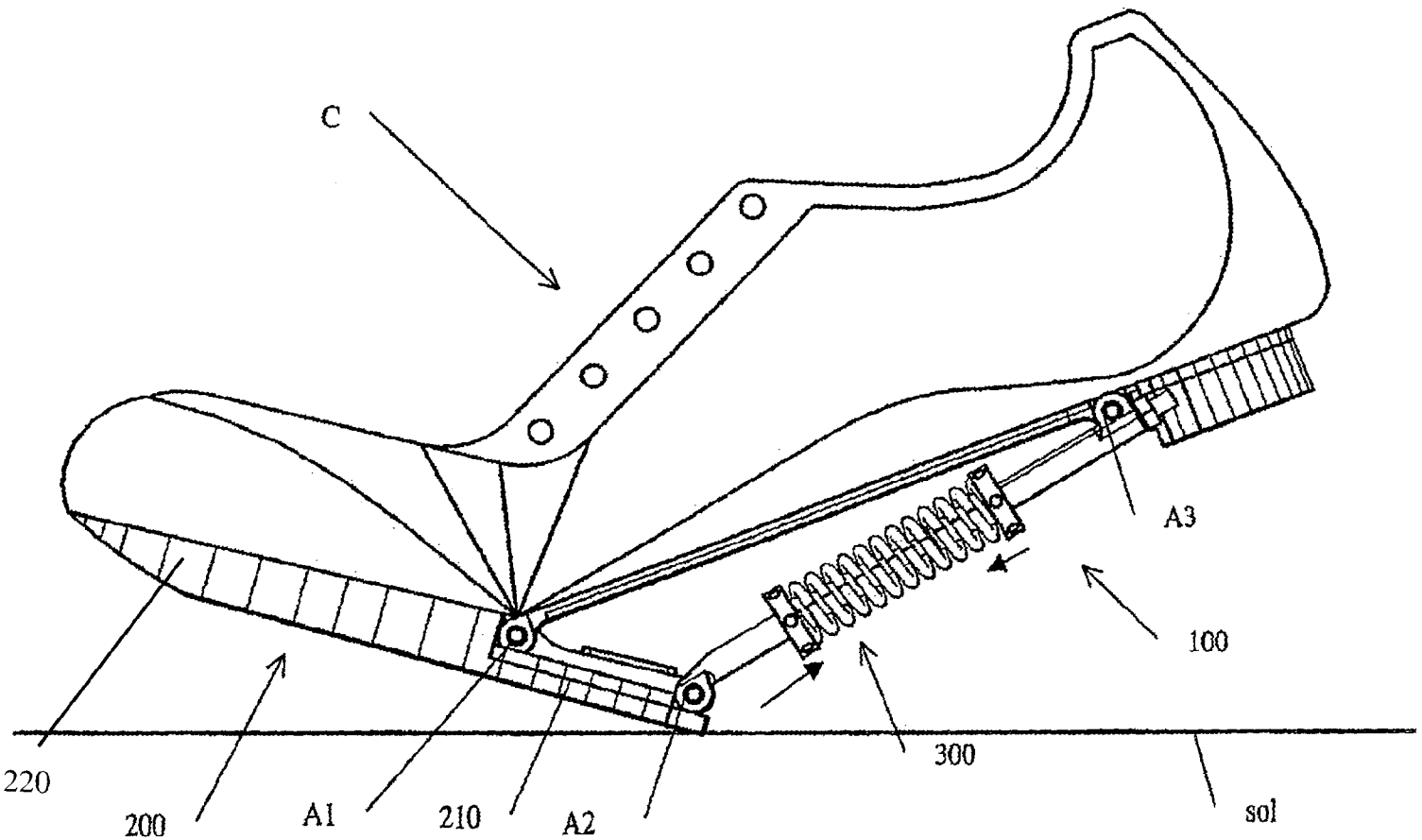
FIG. 1 is a diagrammatical drawing of a side view of a first embodiment of a shoe provided with a sole in accordance with the invention during the reception phase.
Figure 1A:
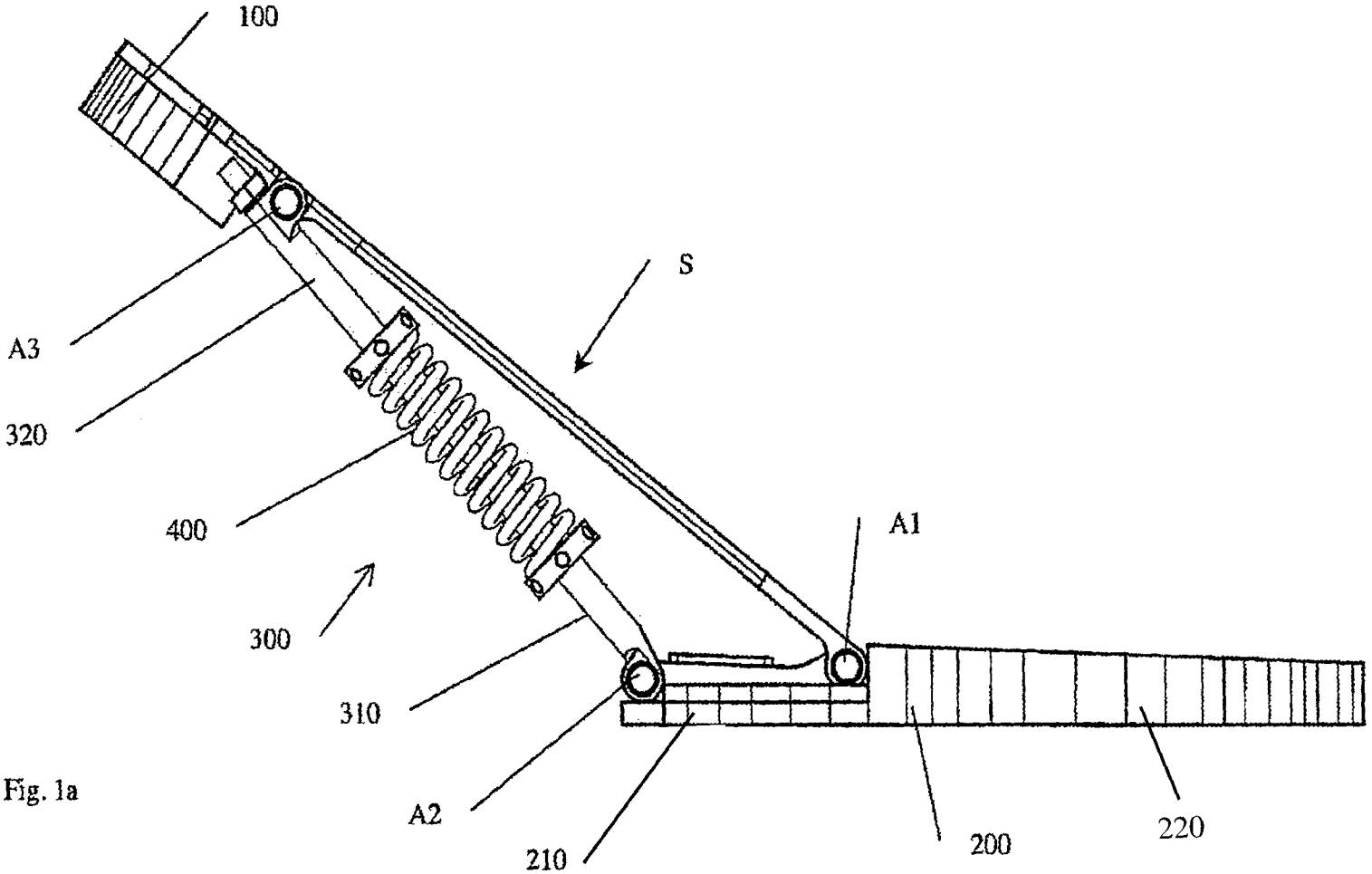
FIG. 1*a* is a side view of the sole of FIG. 1 alone.

Such as shown in the drawings of FIGS. 1 to 4, the sole S can be broken down into two main portions that are pivotably connected together:

- a first rear portion 100 linked to the rear and median zone of the shoe portion of the shoe C, and
- a second front portion 200 linked to the zone of the forepart of the shoe portion of the shoe C.

These two portions of soles 100 and 200 are pivotably connected according to a first horizontal cross pin referenced as A1 located substantially under the natural joint between the forepart and the rear portion of the foot.

In accordance with the invention, the second front portion 200 secured to the shoe portion of the forepart is extended to the rear of the swivel pin A1 in a portion forming a lever arm 210 and is projected to the rear in the same place as that of the front portion. The swivel pin A1 is therefore located in a median position between the front end of the second front portion 200 and the rear end of said lever arm 210. As shown this median position is approximately ⅔ and ⅓, i.e. ⅔ for the front portion linked to a shoe portion, forming front arm 220, and ⅓ for the rear portion linked to the cushion. As such the portion 210 corresponds to one-third of the total length of the portion 200.

The rear end of this arm 210 has a second swivel pin A2 with the end 310 of at least one cushion 300 of which the other end 320 is pivotably connected around a third swivel pin A3 secured to the rear portion 100 of the sole.

This cushion 300 has a variable length, a variation accompanied by an elastic member 400 which will authorize the triangle formed by the three swivel pins A1, A2 and A3 to be flattened in order to compress the cushion and to separate it during the release of the latter. When this triangle is flattened, the three swivel pins become substantially coplanar allowing for the wedging of the cushion in support phase. These phases are shown by the positions shown in the drawings in FIGS. 1 to 3.

In the contact position shown in the drawing in FIG. 1, the shoe C comes into contact with the ground by the intermediary of the portion of sole 210 on the second swivel pin A2. The cushion 300 thus cushions the impact and is compressed all throughout the following phase.

Figure 2:
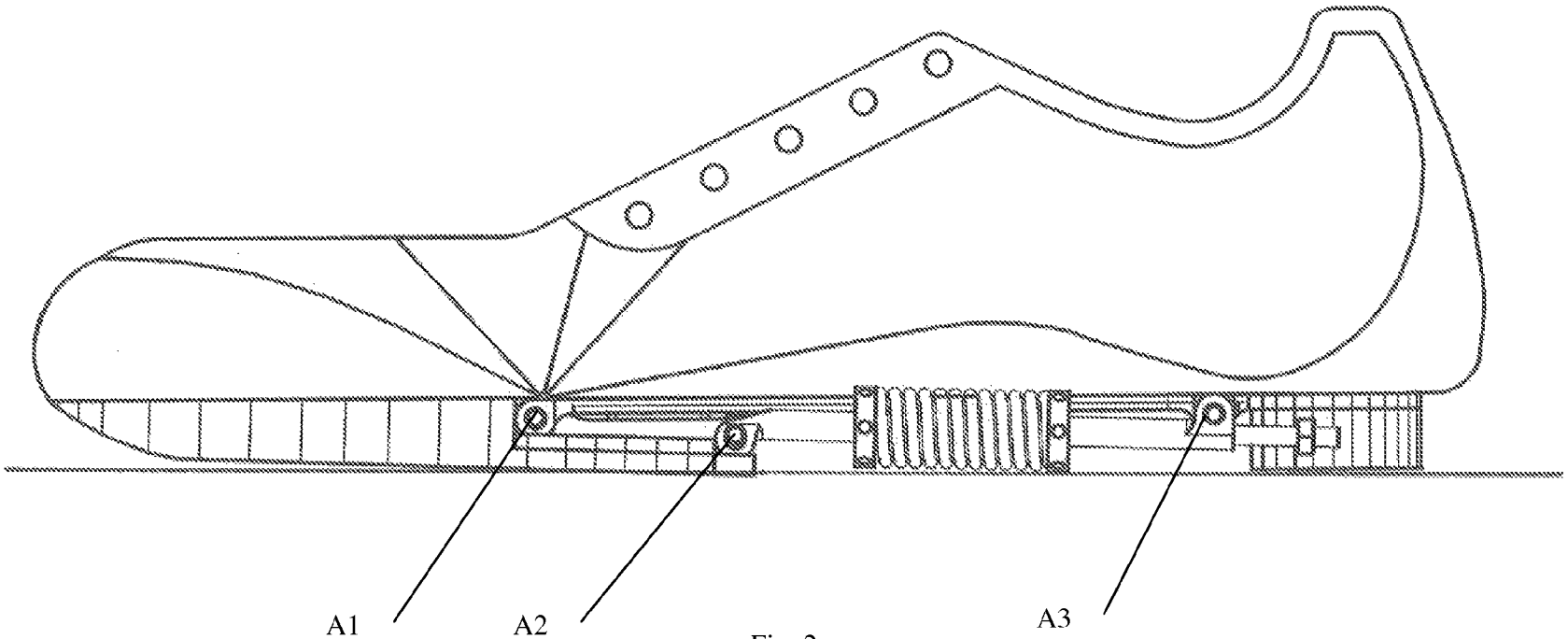
FIG. 2 is a diagrammatical drawing of the shoe of FIG. 1 in support phase.

According to the movement of the foot, this second pin A2 being fixed, the pins A3 then A1 come to join substantially the same plane parallel to the ground in support phase such as shown by the drawing in FIG. 2, with the cushion wedged. The cushion is then in retracted position wherein the rate of compression is the highest. The lower surface of the rear portion 100 of the sole then comes to press against the upper surface of the rear arm 210 of the front portion of the sole.

Figure 3:
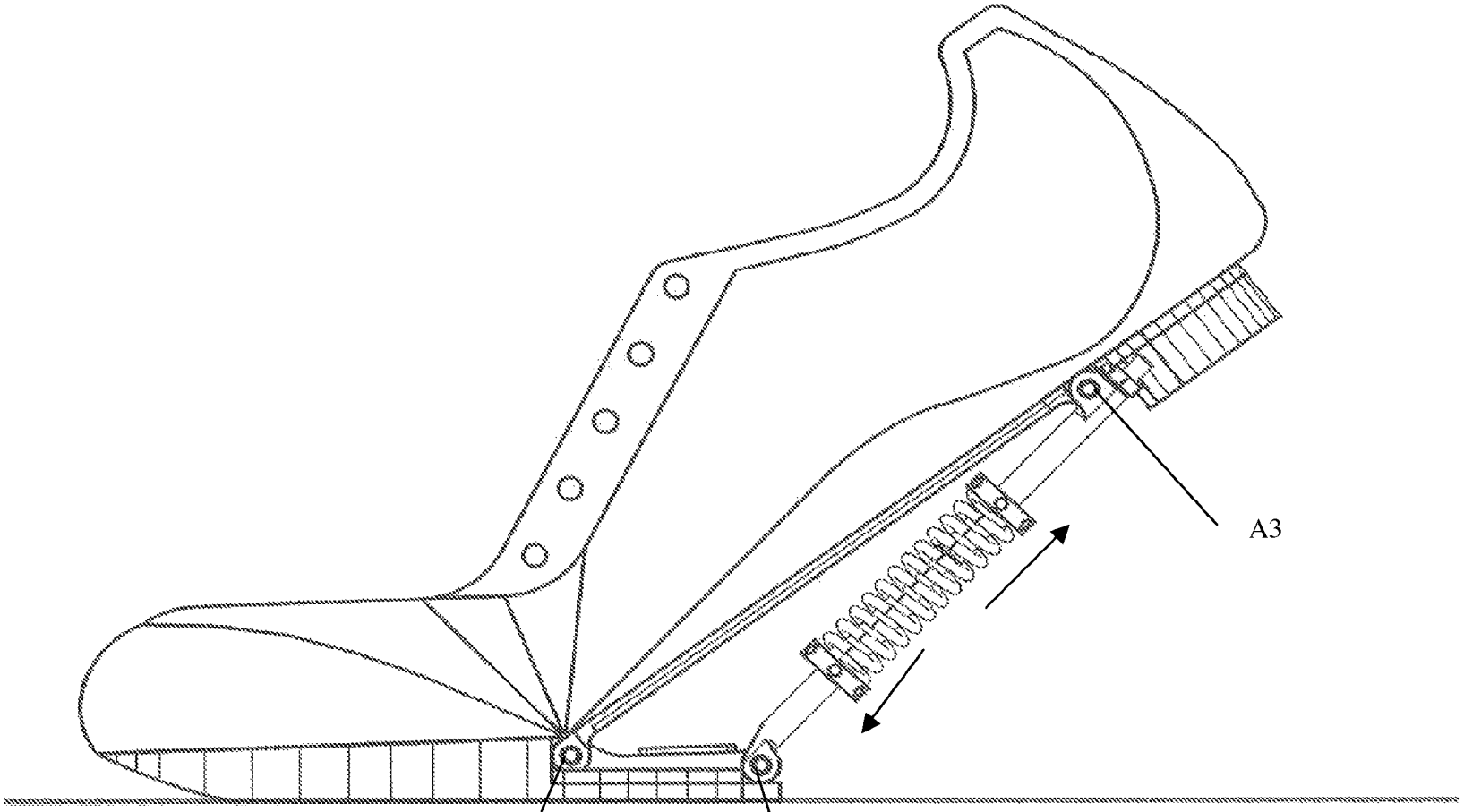
FIG. 3 is a diagrammatical drawing of the shoe of FIG. 1 in thrust phase.

For the propulsion phase shown by the drawing of FIG. 3, the rear portion 100 is raised in relation to the front portion 200 remaining on the ground around the first rotation pin A1 which authorizes the cushion to be unwedged and to be relaxed contributing as such to the propulsion effort by pushing against the ground in A2 and the heel in A3 during the propulsion phase.

Figure 4:
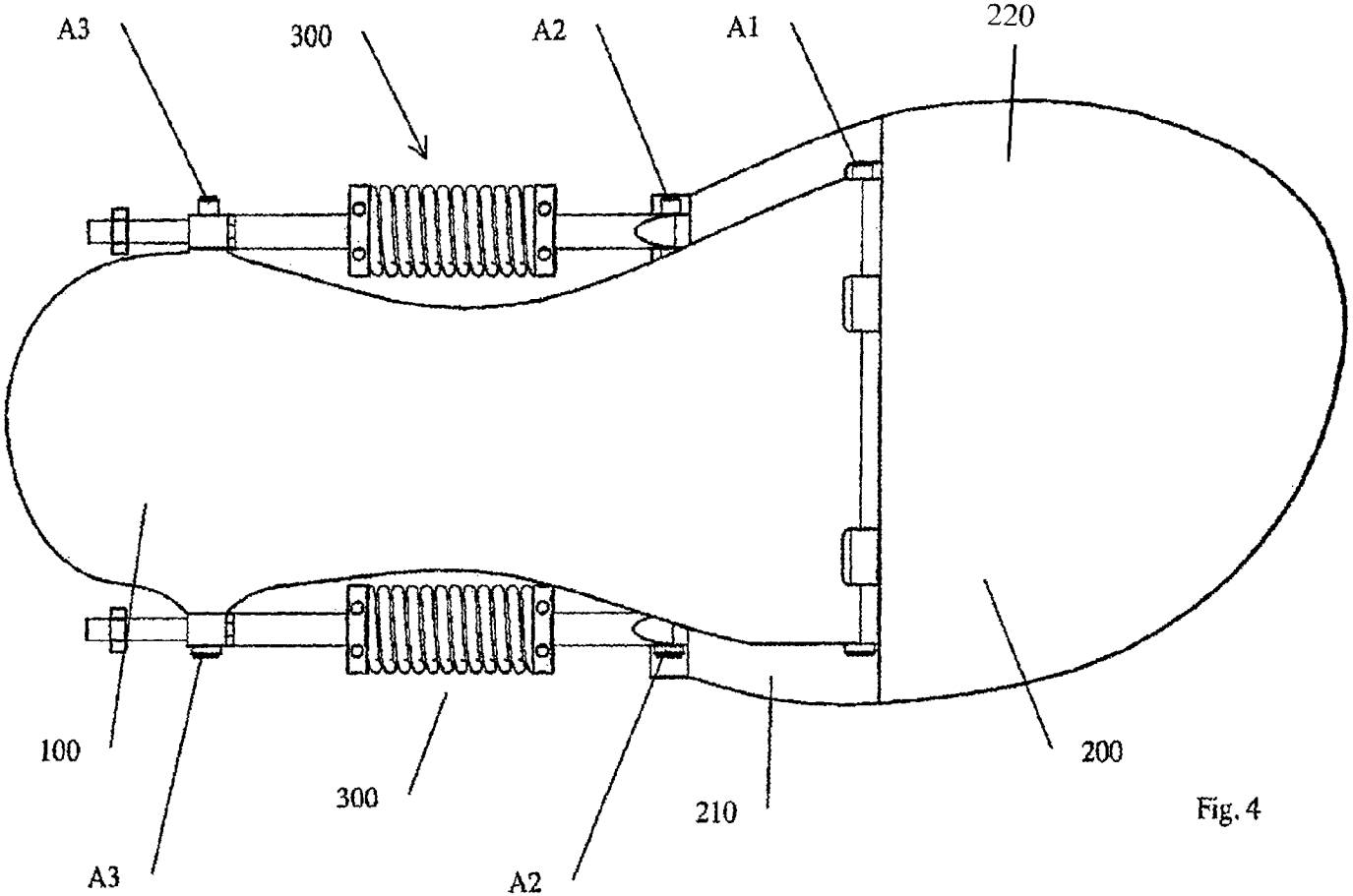
FIG. 4 is a top view of the sole of FIG. 1 alone.

As shown in the drawing of FIG. 4, this embodiment of sole receives two cushions 300 arranged on either side of the rear portion of the sole 100 and positioned to occupy the concave volumes left free under and on either side of the conventional soles.

As such, the sole of the invention has a width of a conventional sole.

It must be underlined that the cushioning devices are provided with elastic modules comprised of helical compression springs. The original use of compression rather than tension prevents the oversizing of the parts constituting the sole preventing an excess thickness that is detrimental to the proper use of the shoe.

This configuration as a triangle of the sole can change to a configuration as a parallelogram such as shown by the drawings of FIGS. 5 to 8.

Figure 5:
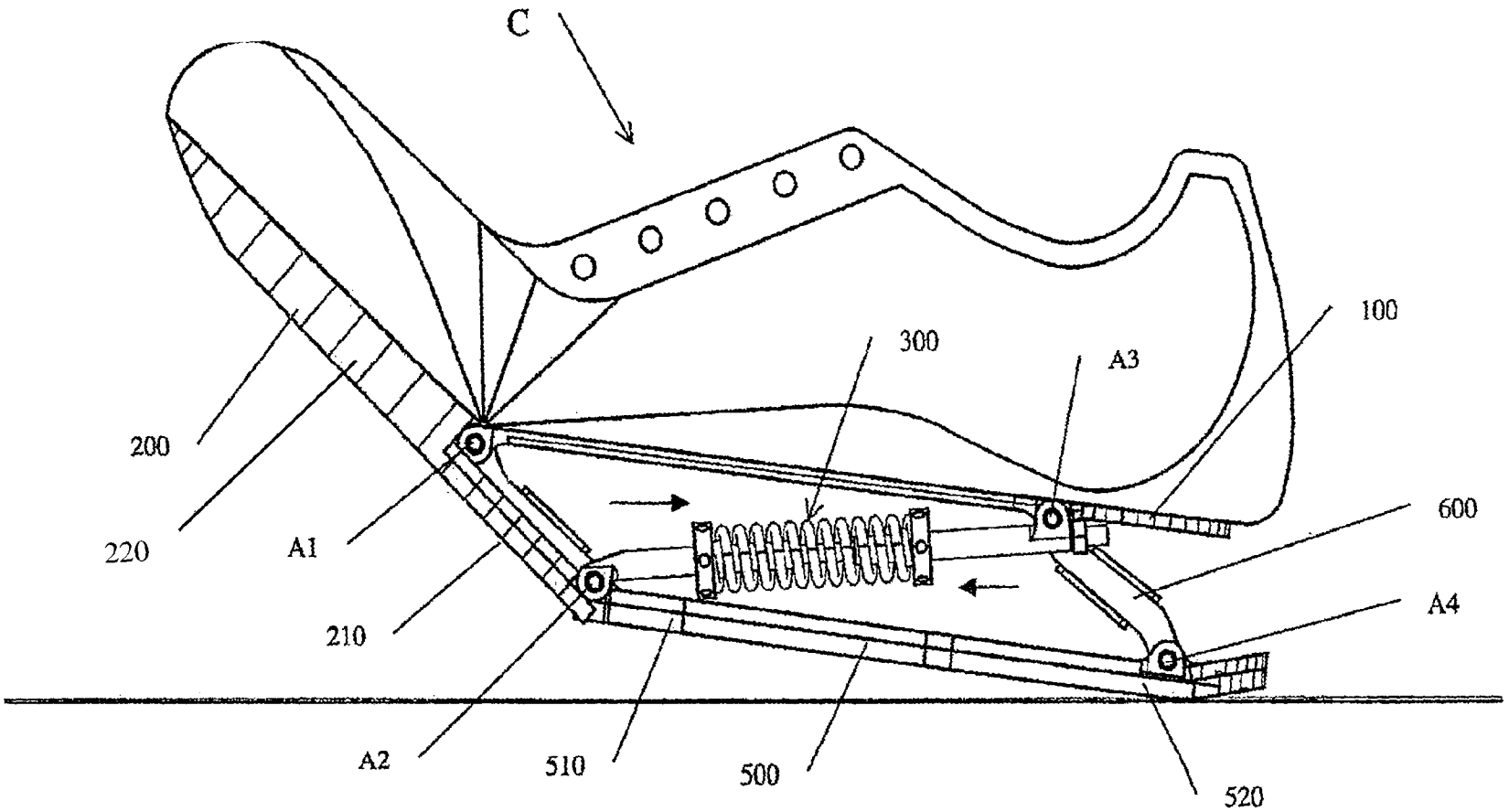
FIG. 5 is a diagrammatical drawing of a side view of a shoe provided with a second embodiment of the sole in accordance with the invention.

This configuration is more adapted to a stride or a gait wherein the heel will first come into contact with the ground S as shown in drawing of FIG. 5 making it possible to cushion said contact by proposing a mobile intermediary sole 500 pivotably connected in relation to the front portion 200 of the sole on the one hand, to a first end 510 around said second swivel pin A2 and on the other hand, around a fourth swivel pin A4 carried by the bottom end of a linking module 600 of which the top end is pivotably connected around the third swivel pin A3. The swivel pin A4 is arranged on said mobile intermediary sole 500 in such a way that the linking module 600 is parallel to the front portion 200 of the sole in such a way as to form a configuration as a parallelogram. As such, the length of the sole 500 is equal to the length of the sole 100, the arms 600 have a length equal to the arm 210.

Figure 6:
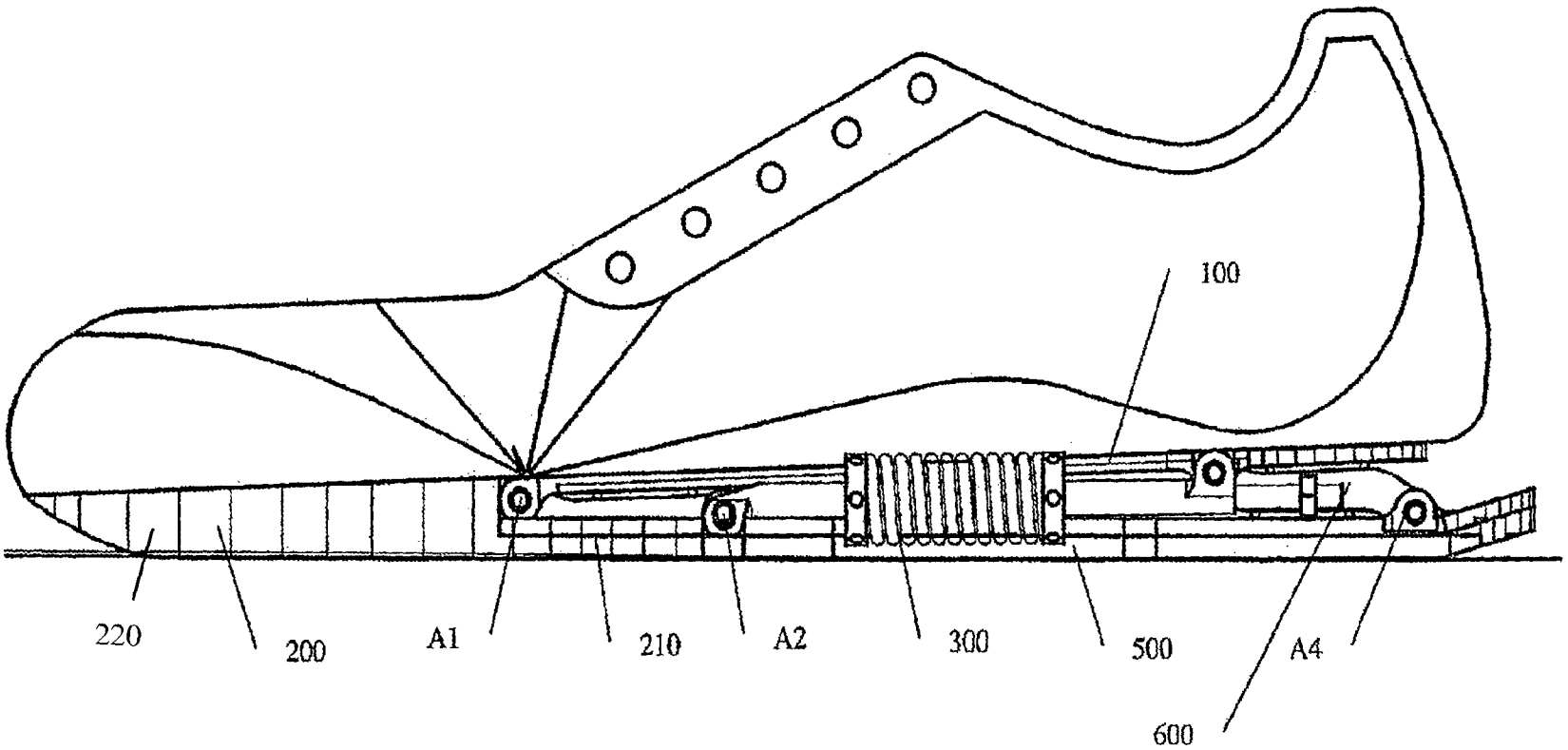
FIG. 6 is a diagrammatical drawing of the shoe of FIG. 5 in support phase.
Figure 7:
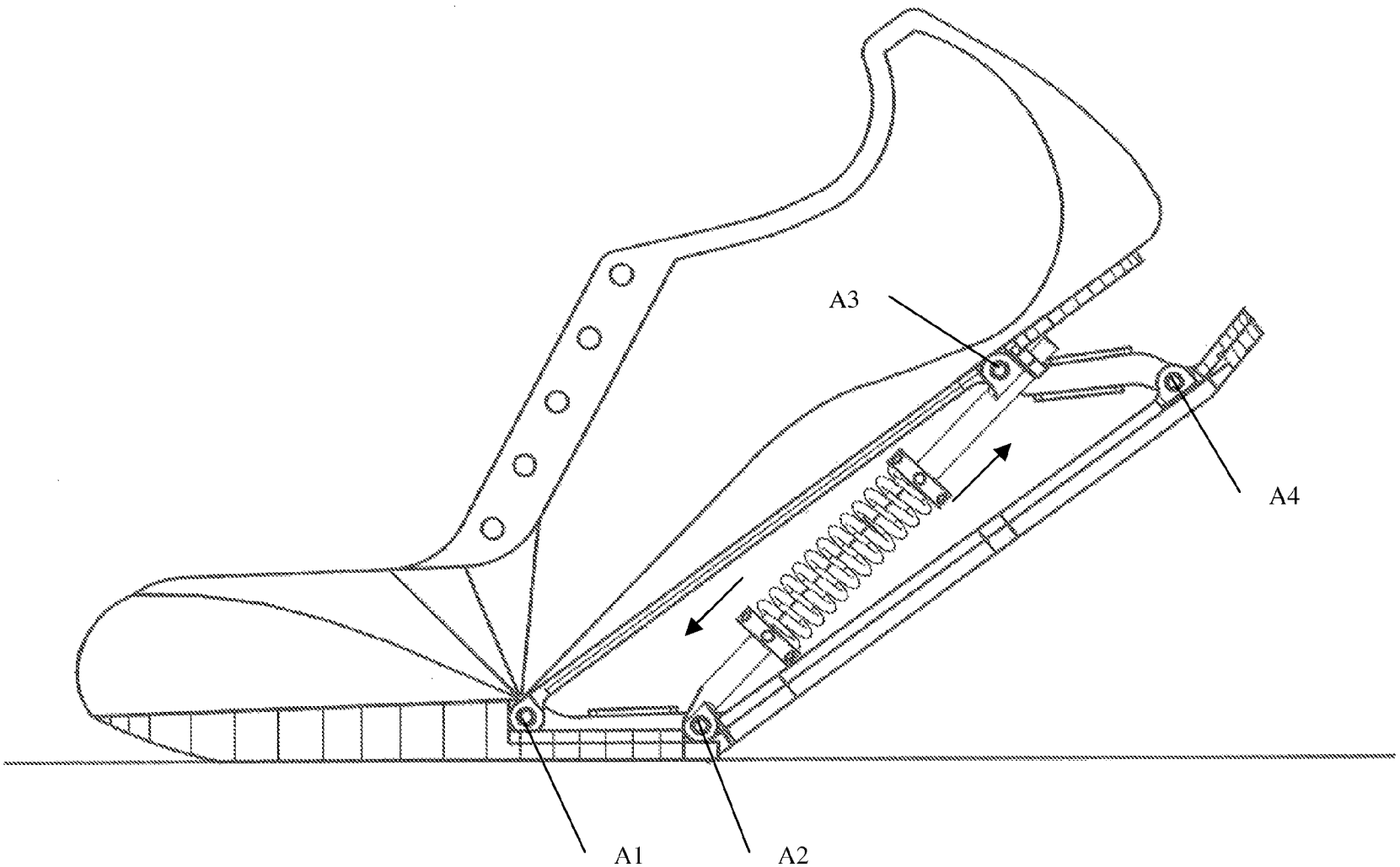
FIG. 7 is a diagrammatical drawing of the sole of FIG. 5 in thrust phase.
Figure 8:
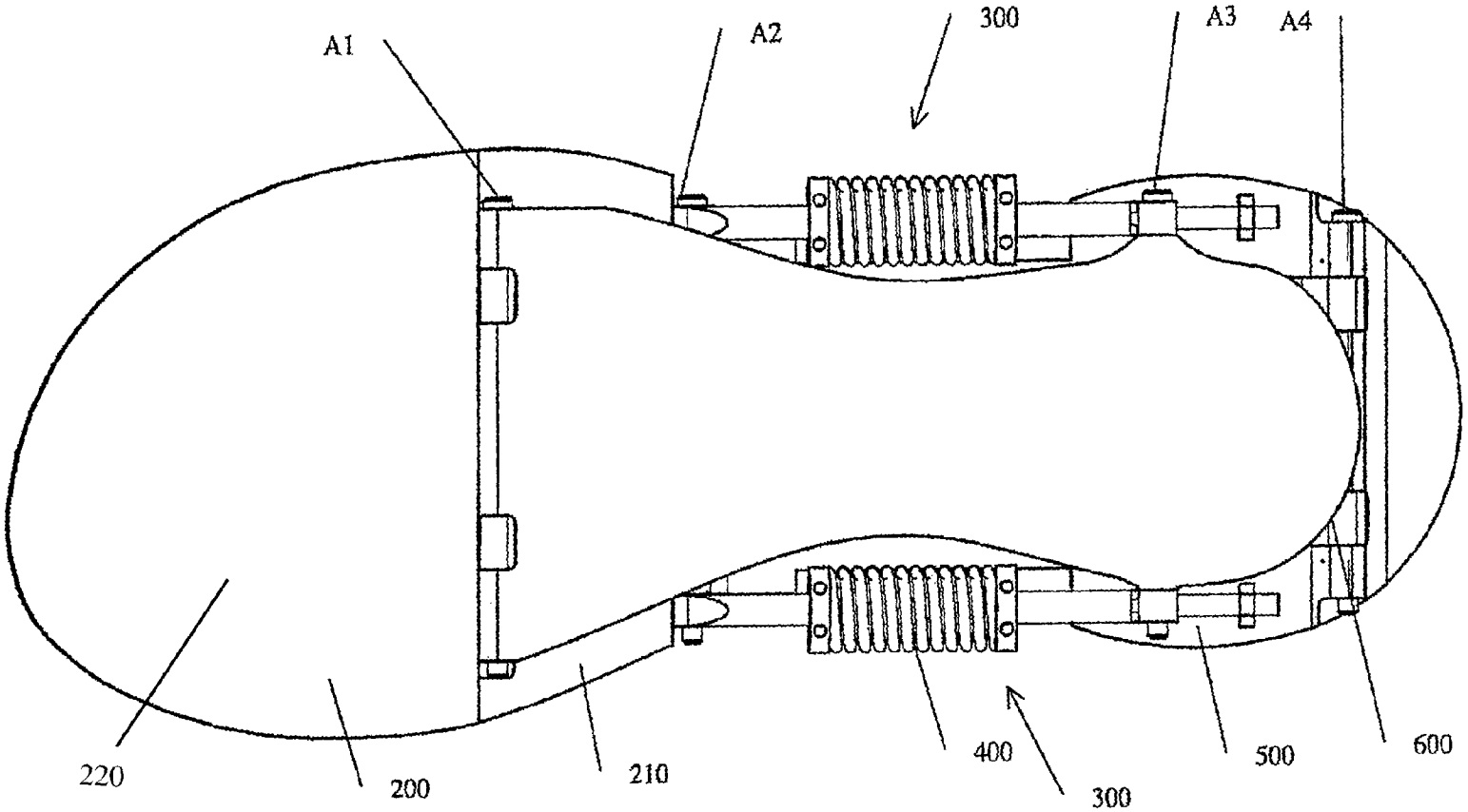
FIG. 8 is a top view of the sole of the FIG. 5 alone.

As shown in the drawing of FIG. 6, the support phase sees the abutting of the lower surface of the rear portion 100 of the sole with the upper surface of the rear arm 210 and of the intermediary sole 500. The various swivel pins are then substantially coplanar.

The operating principle is equivalent to that of the configuration as a triangle with regards to the compression, the maintaining in compressed position and the relaxing. Simply, it is no longer the front portion 200 of the sole that comes into contact first and triggers the folding of the triangle but the rear portion of the mobile intermediary sole 500 which provokes the beginning of the folding of the parallelogram.

FIGS. 9 to 12 show a particularly advantageous characteristic of the invention proposing to engage and to disengage the elastic modules and therefore the cushions without blocking the pivoting connections.

Although this characteristic is shown based on a configuration as a parallelogram, the latter can also be applied on a configuration as a triangle since the locking and/or the unlocking relates to the link between the rod of the cushion 300' and the pivoting connection point to which it is linked.

Figure 9:
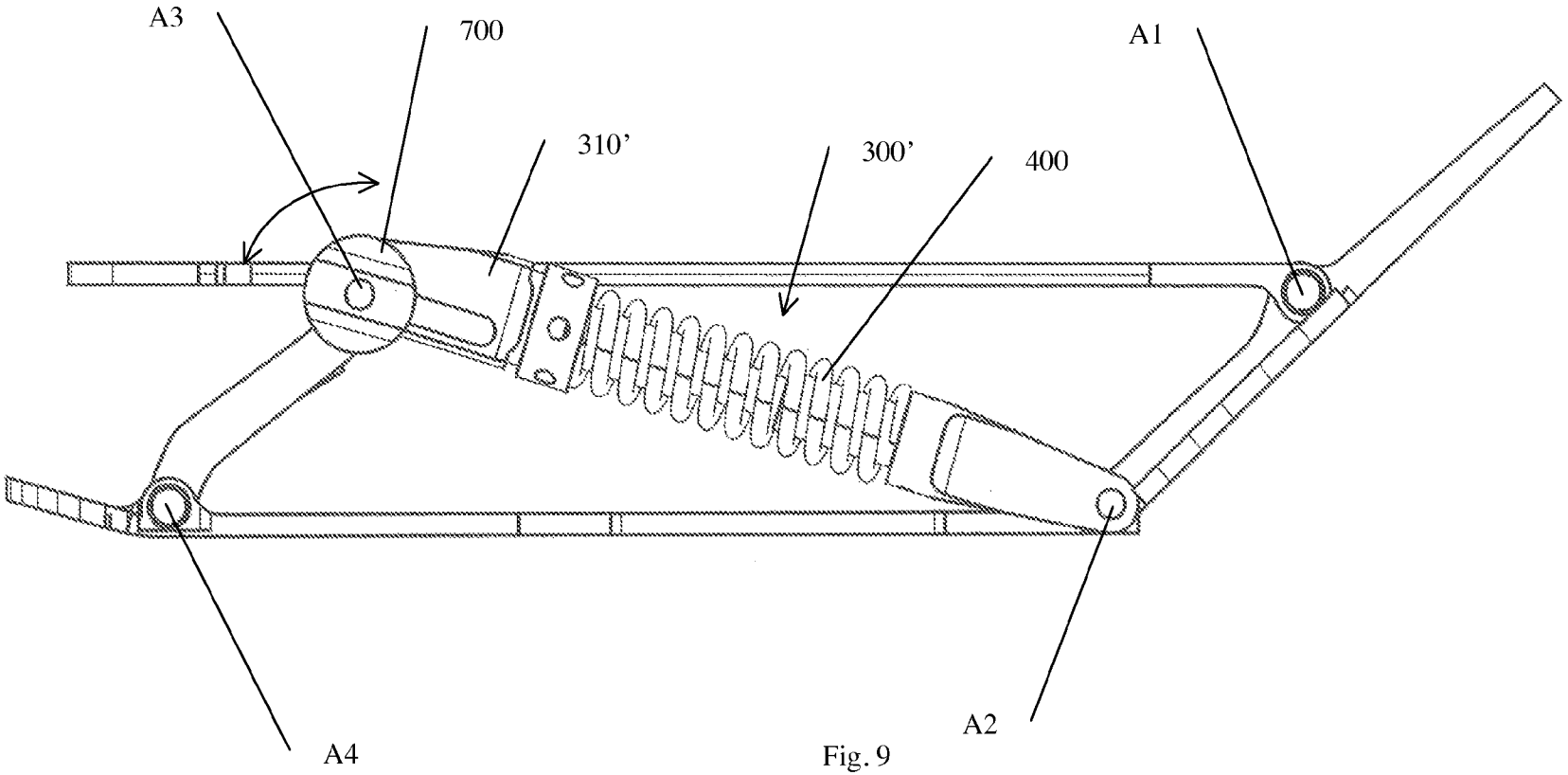
FIG. 9 is a diagrammatical drawing of a third embodiment of a sole provided with a means of locking in position.

As shown in the drawing of FIG. 9, the top end of the rod of the cushion 300' is provided with a head cooperating with a control button 700.

Figure 10:
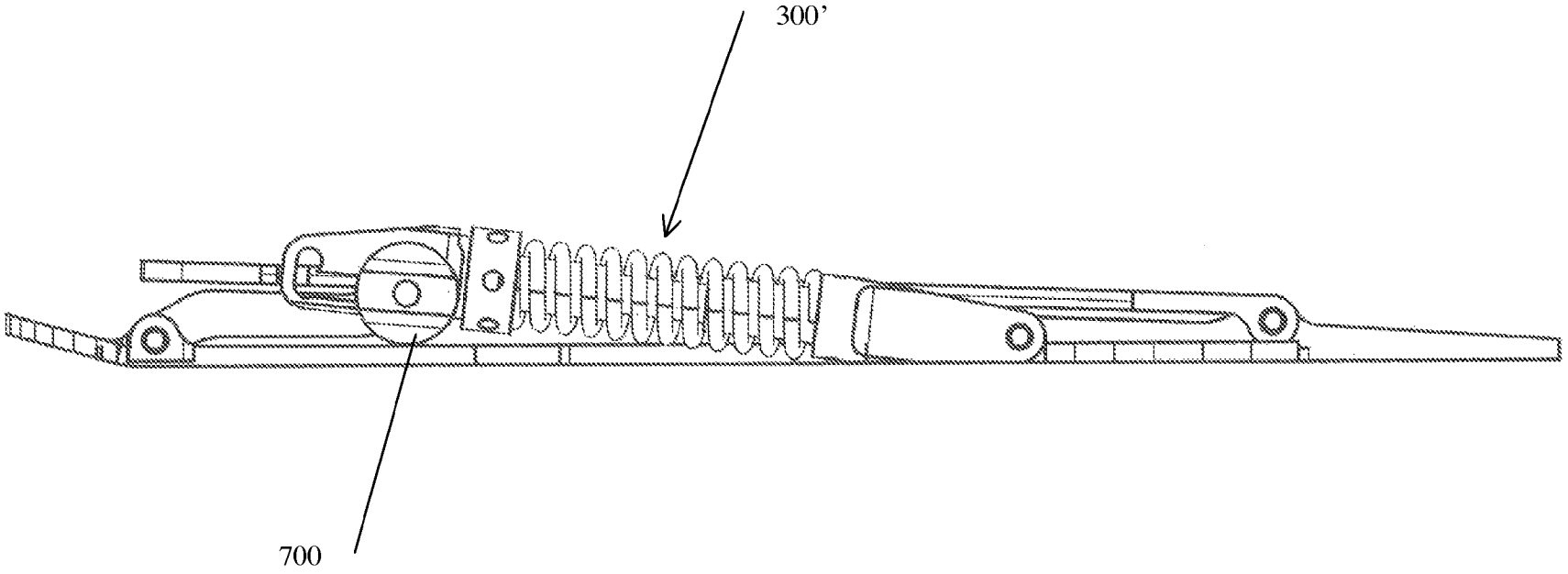
FIG. 10 is a side view of the sole of FIG. 9 in unlocked bottom position.
Figure 11:
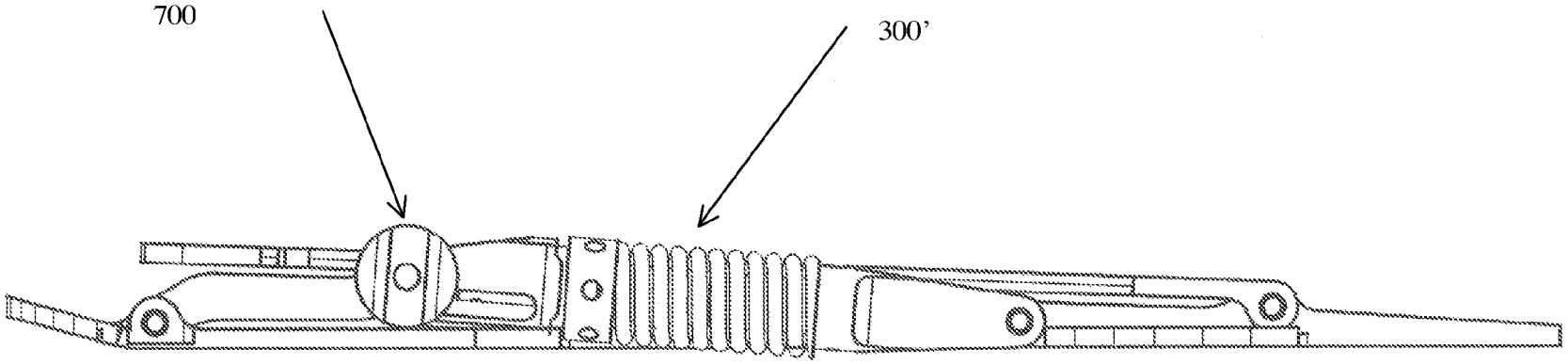
FIG. 11 is a side view of the sole of FIG. 9 in locked bottom position.

This control button 700 switches via rotation from the disengaged position shown in the drawings in FIGS. 9 and 10 wherein the cushion 300' is deployed regardless of the phase that the sole is in, with the position of the pin A3 not influencing the compression of the spring 400, to the engaged position shown in the drawing in FIG. 11 wherein the head 310' is pivotably connected according to a pivot link alone to the pin A3 in such a way that the relative movements of translation of the pin A3 in relation to the pin A2 are transferred to or accompanied by the cushion 300'.

Figure 12:
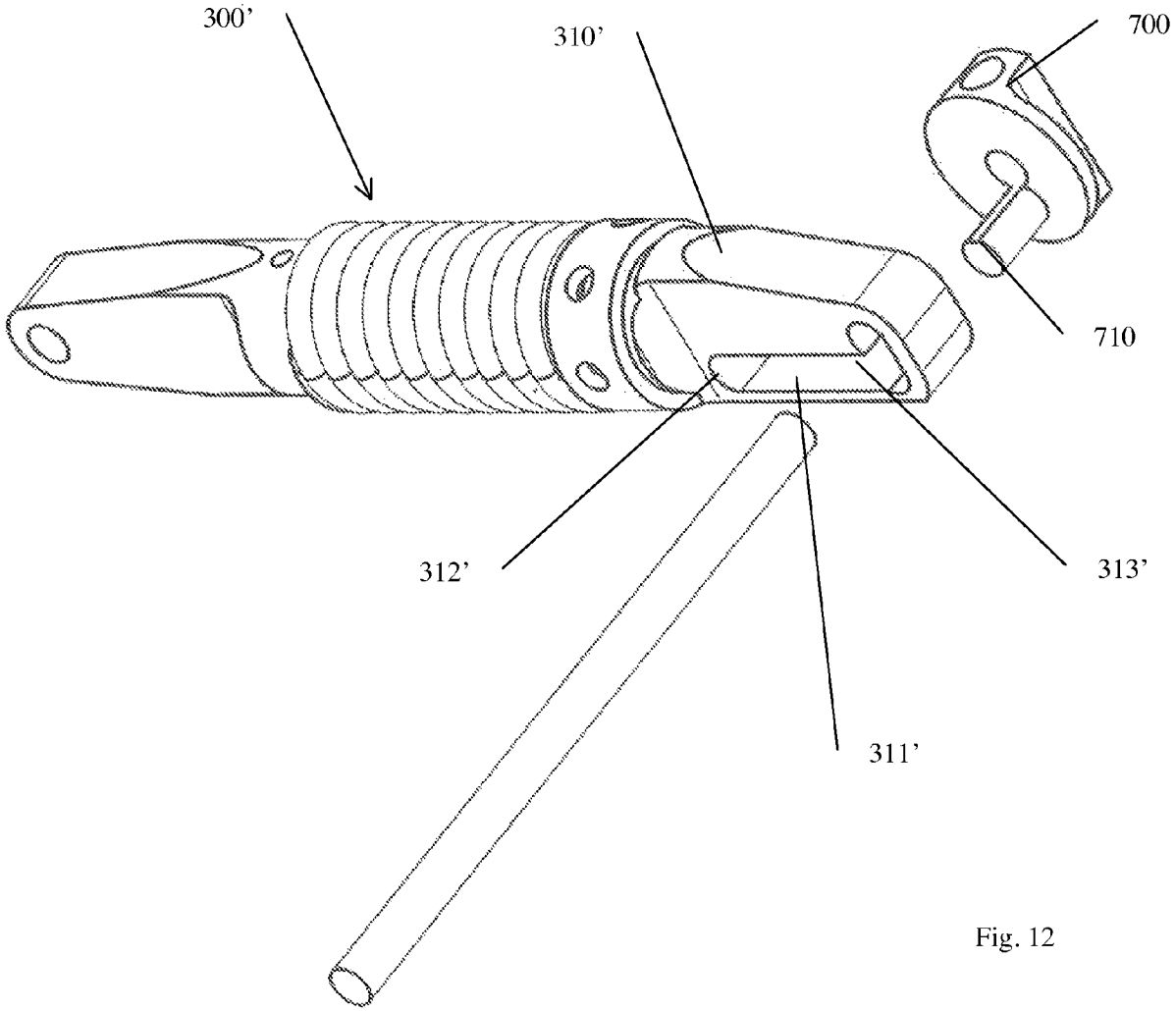
FIG. 12 is an exploded perspective view of the cushion and of the module for locking.

The controlling of said engaging is shown in more detail in the drawing of FIG. 12. As shown, the control button 700 is provided with a cylindrical projection forming a crank pin 710 that is off-centered in relation to its axis of rotation.

This crank pin 710 cooperates for the purposes of sliding or maintaining in position with a path 311' made in the head 310' of the cushion 300. This path 311' has a portion 312' parallel to the axis of the spring 400 and a portion 313' perpendicular to the latter. The rotation of the button 700 makes it possible to switch the crank pin 710 from a disengaged position wherein the rotation pin A3 and the axis of the crank pin 710 are in the parallel portion 312' to an engaged position wherein the rotation pin A3 and the axis of the crank pin 710 are in the perpendicular portion 313' of the path 311' made in the head 310'.

Figure 13:
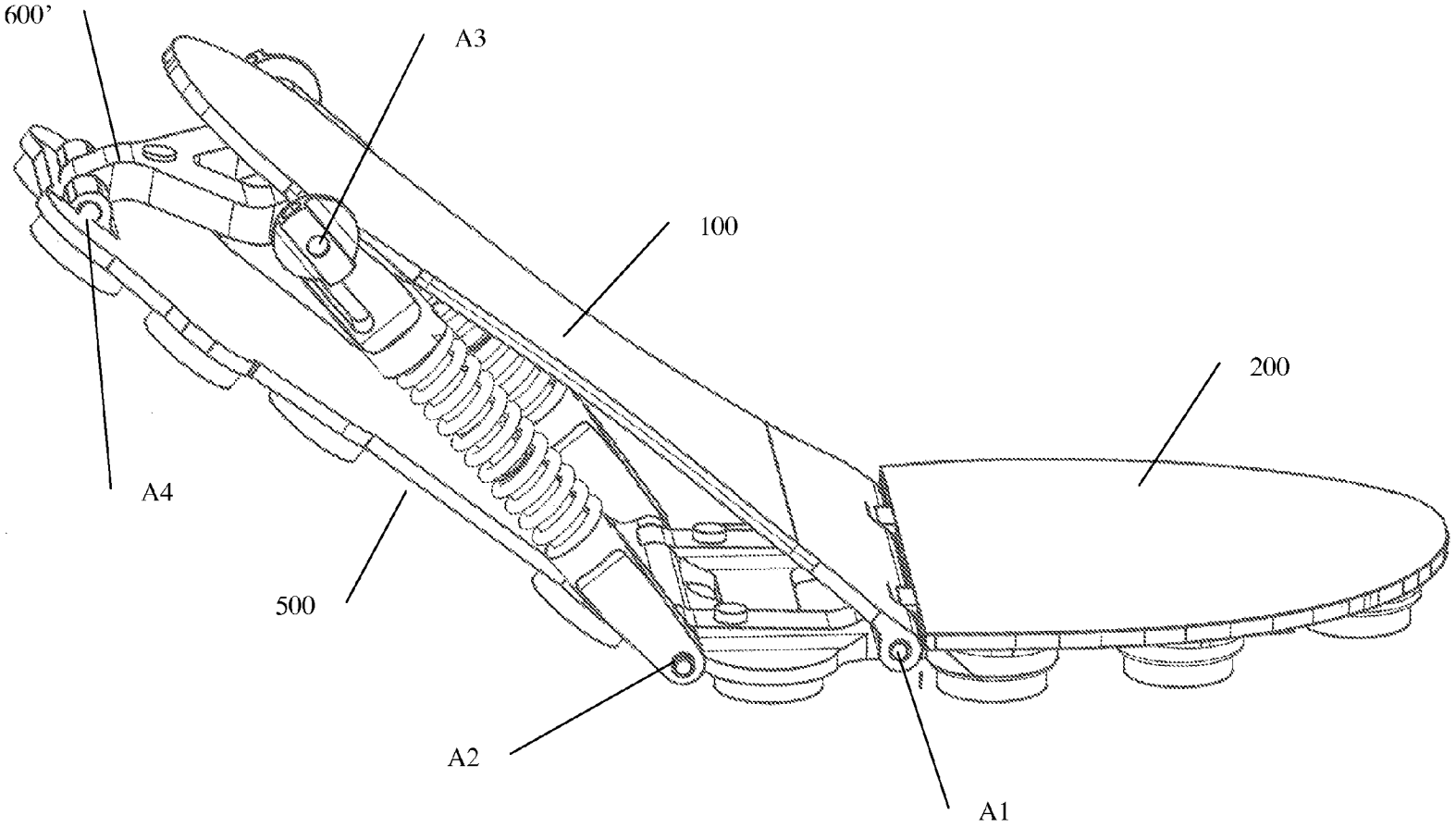
FIG. 13 is a perspective view of a fourth embodiment.

In the embodiment shown in drawing of FIG. 13, the rear arm 600' is comprised of a triangle which is carried out in a semi-rigid deformable material allowing the two platforms 100 and 500 formed by the parallelogram to not remain parallel at the first contact with the ground in order to return to a parallel state at the end of travel when the two platforms 100 and 500 come to abut which facilitates the natural pronation. According to another embodiment not shown, said arm is comprised of two independent arms.

Figure 14:
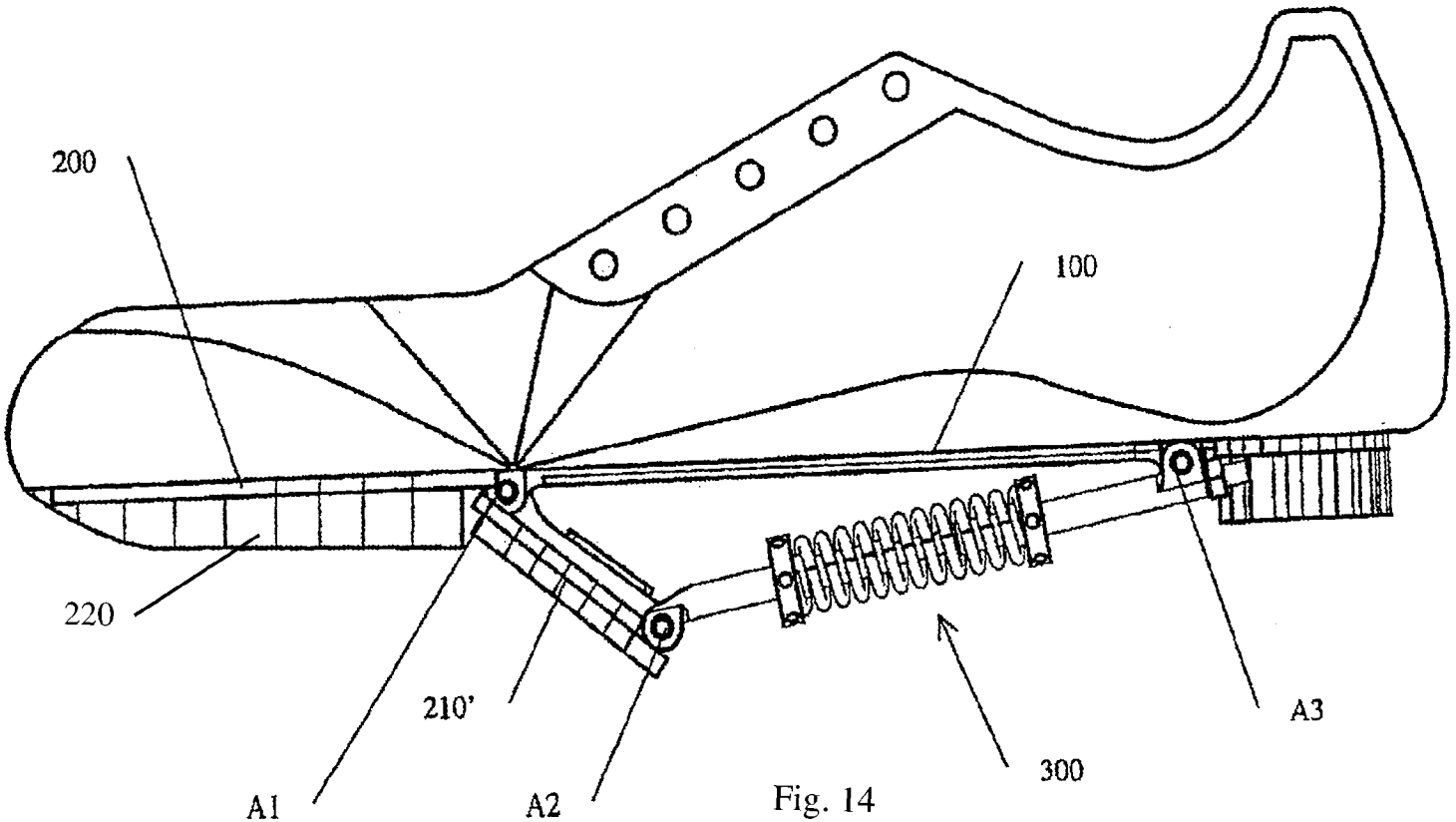
FIG. 14 is a perspective view of a fifth embodiment.

FIG. 14 also shows a particular embodiment of the sole in that the shoe comprises a lever arm 210' also pivotably connected to the front portion 200 coaxially to the swivel pin of the rear portion with the front portion of sole A1 providing an additional pivoting connection. Such a pivoting connection facilitates the implementation of the locking of the elastic module in compressed position.

It is understood that the shoe, which has just been described hereinabove and shown, has been in light of a disclosure rather than a limitation. Of course, various arrangements, modifications and improvements can be made to the example hereinabove, without however leaving the scope of the invention.

As such, for example the elastic module is of the gas spring type.

In addition, the material used for the elements of the sole and of the arm are semi-rigid of the plastic or composite type. They are made of hard material of the steel or ceramic type for the pins and other linking parts.

The invention claimed is:

1. A shoe comprising a shoe portion and a single sole, the shoe portion comprising a forepart, a median zone, and a rear portion, the sole comprising:

a first portion linked to the rear portion and the median zone of the shoe portion of the shoe, and a second portion secured to the forepart of the shoe portion of the shoe, the first portion of the sole and the second portion of the sole being pivotally connected together with a first horizontal swivel pin adapted to be located substantially under the natural joint between the forepart and the rear portion of the foot, characterized in that the second portion of the sole extends to the rear of said first swivel pin forming a lever having a front arm and a rear arm in a proportion substantially equal to ⅔ and ⅓, with about ⅔ of the second portion of the sole being linked to the forepart of the shoe portion forming the front arm of the lever and about ⅓ of the second portion of the sole extending to the rear of the first swivel pin forming the rear arm of the lever and being projected to the rear in the same plane as that of the front arm of the lever and kinetically secured to the front arm of the lever, the first swivel pin forming the fulcrum of the lever, the rear end of the rear arm having a second swivel pin pivotally connected to one end of a compressible elastic module having two ends, the other end of the elastic module being pivotably connected to a third swivel pin secured to the rear end of the rear portion of the sole, the three swivel pins forming a triangle when the elastic module is not compressed, and such that when the triangle formed by the three swivel pins is flattened, the three pins become substantially coplanar and the elastic module is compressed and wedged, the shoe further comprising a mobile intermediary sole and a linking module having a top end and a bottom end, the mobile intermediary sole being pivotally connected, to said second swivel pin and to a fourth swivel pin carried by the bottom end of the linking module, the top end being pivotally connected to the third swivel pin, the fourth swivel pin being positioned on said mobile intermediary sole such that the linking module is parallel to the front portion of the sole such that the first portion of the sole, the linking module, the mobile intermediary sole, and the rear arm form a parallelogram.

2. A shoe according to claim 1, characterized in that the shoe comprises two elastic modules, the sole having concave volumes on either side corresponding to the natural outside and inside cavities of the arch of the foot, the two elastic modules being arranged in the concave volumes of the sole.

3. A shoe according to claim 1, characterized in that said elastic module operates in compression.

4. A shoe according to claim 1, characterized in that the stiffness of the elastic module is defined in such a way that the weight of the user on the shoe makes it possible to reach the support position wherein the elastic module is inactive in relation to the shoe wherein the lower surface of the rear portion of the sole comes into contact with the upper surface of the rear arm of the front portion of the sole.

5. A shoe according to claim 1, characterized in that said elastic module comprises a spring.

6. A shoe according to claim 5, characterized in that the stiffness of said elastic module is adjusted via the use of screw stiffeners or by the replacement of springs for the same module.

7. A shoe according to claim 2, characterized in that the elastic modules have different degrees of stiffness on either side of the foot.

8. A shoe according to claim 1, characterized in that it comprises a means for locking the two sole assembly portions together in a support phase wherein they are coplanar, the means for locking including a disengagement device switchable by the user between a disengaged position to an engaged position for unlocking and locking the elastic module to the third swivel pin.

9. A shoe according to claim 1, characterized in that it comprises a disengaged device switching as controlled by the user, from a disengaged position wherein the elastic module or modules are inactive and free to an engaged position wherein the elastic module or modules accompany the movement of the portions of the sole.

10. A shoe according to claim 1, characterized in that the lower and upper surfaces of the soles come into contact on linking module when the elastic module is compressed or inactive.

11. A shoe according to claim 1, characterized in that it comprises a lever arm also pivotably connected to the front portion coaxially to said first swivel pin of the rear portion with the front portion of sole.

12. A shoe according to claim 11, characterized in that it comprises a means for locking the elastic module in compressed position, the means for locking including a disengagement device switchable by the user between a disengaged position to an engaged position for unlocking and locking the elastic module to the third swivel pin.

* * * * *